US011759000B2

(12) United States Patent
Humphreys et al.

(10) Patent No.: US 11,759,000 B2
(45) Date of Patent: Sep. 19, 2023

(54) BACKPACK FRAME

(71) Applicant: CABELA'S LLC, Sidney, NE (US)

(72) Inventors: Lucas Humphreys, Sidney, NE (US); Ryan Shutts, Sidney, NE (US); Laurence Robinson, Sidney, NE (US)

(73) Assignee: CABELA'S LLC, Sidney, NE (US)

( * ) Notice: Subject to any disclaimer, the term of this patent is extended or adjusted under 35 U.S.C. 154(b) by 70 days.

(21) Appl. No.: 17/316,169

(22) Filed: May 10, 2021

(65) Prior Publication Data

US 2021/0393023 A1 Dec. 23, 2021

Related U.S. Application Data

(63) Continuation of application No. 14/818,154, filed on Aug. 4, 2015, now abandoned.

(60) Provisional application No. 62/033,568, filed on Aug. 5, 2014.

(51) Int. Cl.

| | |
|---|---|
| ***A45F 3/08*** | (2006.01) |
| ***A45F 3/10*** | (2006.01) |
| *A45F 3/04* | (2006.01) |

(52) U.S. Cl.

CPC ..... *A45F 3/08* (2013.01); *A45F 3/10* (2013.01); *A45F 2003/045* (2013.01)

(58) Field of Classification Search

CPC ..... A45F 2003/045; A45F 2004/006; A45F 3/047; A45F 3/08; A45F 3/10

USPC ..... 224/261–263, 600, 611, 633–636

See application file for complete search history.

(56) References Cited

U.S. PATENT DOCUMENTS

| | | | | |
|---|---|---|---|---|
| 4,135,654 A * | 1/1979 | Chu | ..... | A45F 3/08 224/261 |
| 4,369,903 A * | 1/1983 | Wilkes | ..... | A45F 3/08 224/635 |
| 5,904,282 A * | 5/1999 | Gleason | ..... | A45F 3/08 224/636 |
| 9,271,560 B2 * | 3/2016 | Buffinton | ..... | A45F 3/08 |

FOREIGN PATENT DOCUMENTS

| | | | | |
|---|---|---|---|---|
| EP | 1859703 A1 * | 11/2007 | ..... | A45F 3/08 |

* cited by examiner

*Primary Examiner* — Nathan J Newhouse
*Assistant Examiner* — Matthew T Theis
(74) *Attorney, Agent, or Firm* — King & Spalding LLP

(57) ABSTRACT

A backpack includes an upper cross member having a first end and a second end, and a lower cross member offset vertically from the upper cross member and having a third end and a fourth end. The frame includes a first rail connected to the upper cross member at the first end and the lower cross member inwards of the third end, and a second rail fixed to the upper cross member inwards from the first end and the lower cross member at the third end.

12 Claims, 8 Drawing Sheets

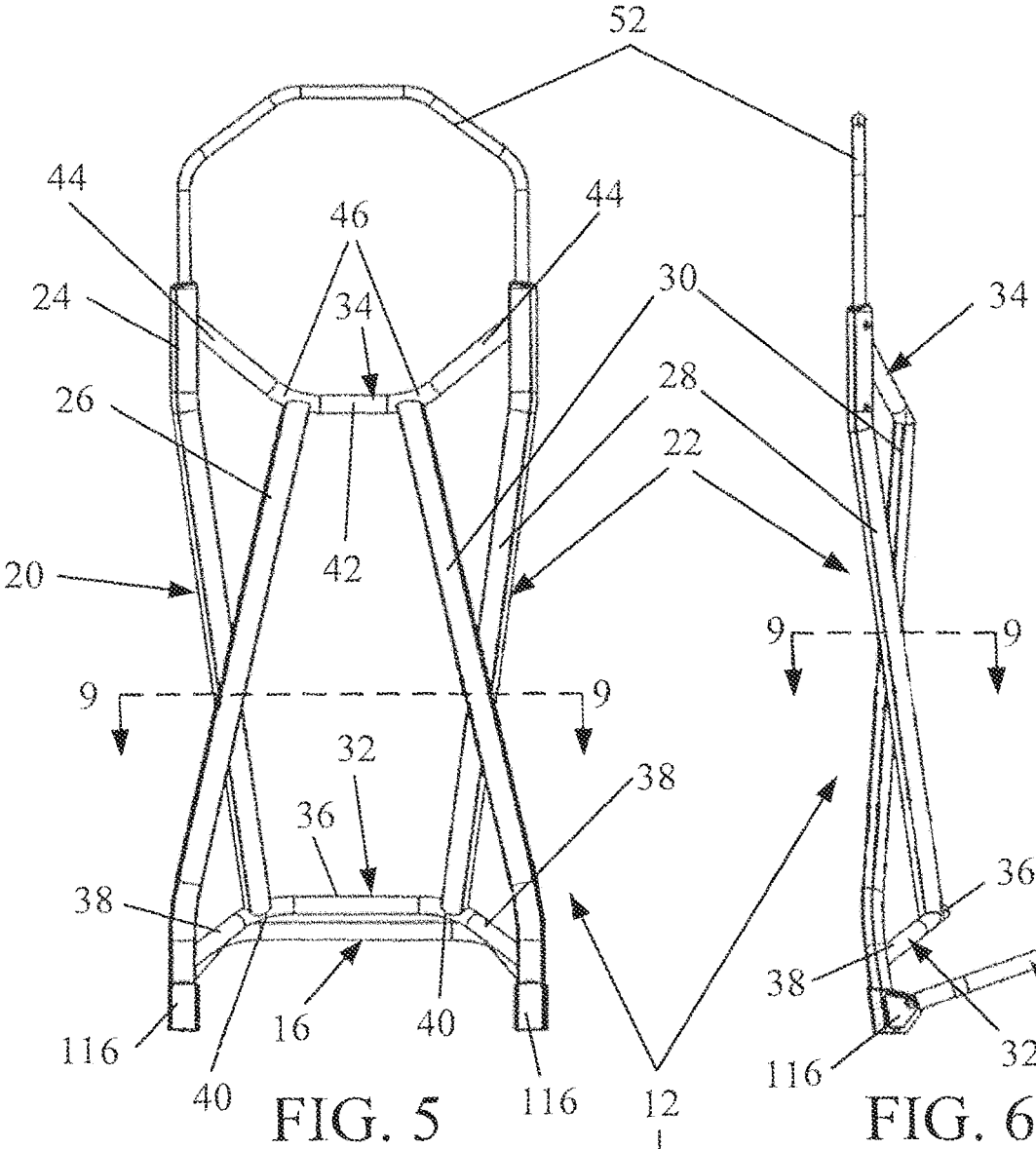
FIG. 5
FIG. 6
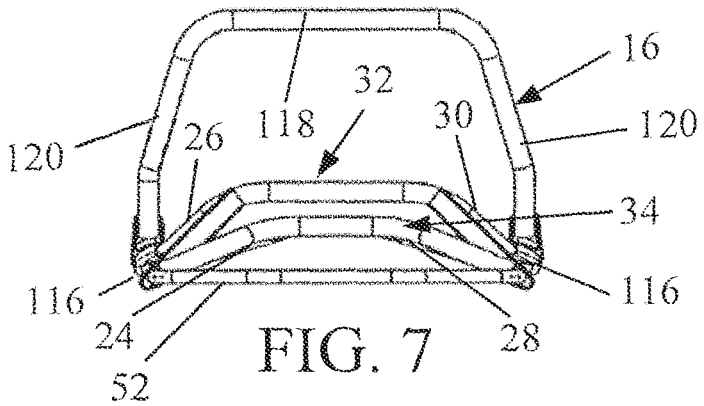
FIG. 7

BACKPACK FRAME

CROSS-REFERENCE TO RELATED APPLICATIONS

This application is a continuation of U.S. patent application Ser. No. 14/818,154 filed on Aug. 4, 2015. This application claims the benefit of U.S. Provisional Application No. 62/033,568, filed on Aug. 5, 2014. The entire disclosure of each of the above applications are incorporated herein by reference.

FIELD OF THE DISCLOSURE

This disclosure relates to frames for backpacks, and in particular to a backpack frame having an improved tubular frame configuration.

BACKGROUND OF THE DISCLOSURE

Backpacks are typically used to carry a heavy and/or bulky cargo on the back of a user. Backpacks help distribute the weight of the cargo within the backpack between the shoulders and hips of the user. Backpacks typically fall within three categories: frameless backpacks, internal frame backpacks, and external frame backpacks. Frameless backpacks, as the name suggests, have no frame. Internal frame backpacks utilize an internal frame of metal or plastic inside the pack, as well as a series of straps to distribute and hold the weight of the cargo of the backpack in place.

External frame backpacks typically include an external frame made of a rigid material and a harness assembly attached to the external frame for the user to carry the backpack. The frames can be manufactured from a variety of materials, such as wood, aluminum, steel, titanium, or plastic. External frame backpacks are versatile and are used in a variety of settings, including backpacking and hunting, or other situations requiring the moving of a cargo over a distance.

External frame backpacks may have a pack permanently attached to the frame. If the external frame backpack does not have a permanent pack, then a sack, such as a duffel bag, may be attached to the frame using straps and/or cords. External frame backpacks without a permanent pack can be useful in that a user is not confined to a particular size of pack—different size packs can be attached to the frame. Additionally, objects that are not shaped for convenient carrying inside a pack (e.g., such as a walking stick, rifle or shotgun, and the like) can be attached to the frame.

SUMMARY OF THE DISCLOSURE

A backpack frame and frame rail profile are disclosed for providing a strong and light weight frame for a backpack, while providing comfort to a user and versatility in applications.

According to one aspect of the disclosure, a backpack includes a shoulder strap assembly. The shoulder strap assembly includes a right shoulder strap and a left shoulder strap. The backpack includes a hip belt and a frame. The frame includes an upper cross member having a first end and a second end and wherein the shoulder strap assembly is coupled to the upper cross member, a lower cross member offset vertically from the upper cross member and having a third end and a fourth end, and a first rail set having a first rail and a second ran. The first rail is fixed to the upper cross member at the first end and the lower cross member inwards of the third end. The second rail is fixed to the upper cross member inwards from the first end and the lower cross member at the third end. The first rail and the second rail abut along a portion vertically between the upper cross member and the lower cross member. The frame includes a second rail set having a third rail and a fourth rail. The third rail is fixed to the upper cross member at the second end and the lower cross member inwards of the fourth end. The fourth rail is fixed to the upper cross member inwards from the second end and the lower cross member at the fourth end. The first rail and second rail abut along a portion vertically between the upper cross member and the lower cross member.

In another aspect of the disclosure, a frame for a backpack includes an upper cross member having a first end and a second end, a lower cross member offset vertically from the upper cross member and having a third end and a fourth end, and a first rail set having a first rail and a second ran. The first rail is fixed to the upper cross member at the first end and the lower cross member inwards of the third end. The second rail is fixed to the upper cross member inwards from the first end and the lower cross member at the third end. The first rail and second rail abut along a portion vertically between the upper cross member and the lower cross member.

In another aspect of the disclosure, a frame for a backpack includes an upper cross member having a first end and a second end, a lower cross member offset vertically from the upper cross member and having a third end and a fourth end, a first rail connected to the upper cross member at the first end and the lower cross member inwards of the third end, and a second rail fixed to the upper cross member inwards from the first end and the lower cross member at the third end.

These and other features and advantages of the present disclosure will become clear to a person skilled in the art after reading the following detailed description and in consideration of the drawings.

BRIEF DESCRIPTION OF THE DRAWINGS

FIG. 5 is a front view of the frame of the backpack of FIG. 1.

FIG. 6 is a side view of the frame of FIG. 5 taken from the left side of the frame.

FIG. 7 is a top view of the frame of FIG. 5.

Like reference numerals in the drawings indicate like components, parts, or operations.

DETAILED DESCRIPTION

The following describes one or more example embodiments of the disclosed frame for a backpack and tubing profile for the rails of the frame, as shown in the accompanying figures of the drawings described briefly above. Various modifications to the example embodiments may be contemplated by one of skill in the art.

As noted above, it is desirable to provide a lightweight backpack, which is strong enough to support heavy cargo, can be used for a variety of tasks, provides comfort, and does not restrict movement of the user. The present backpack frame can be used in a backpack enabling the backpack to accommodate cargo in heavy, oversized, and/or awkwardly shaped configurations. Additional components and straps may be connected to the backpack and used to help support the cargo and position the cargo such that it is near the user's back and center of gravity. A vertical direction with respect to the backpack 10 is defined as the direction perpendicular to the ground. A lateral direction is defined as the direction toward (forward) and away from (aft) a user when the backpack 10 is worn by a user. A horizontal direction is defined as being perpendicular to both the lateral direction and vertical direction, with right being the direction to the right of a user wearing the backpack 10, and left being the direction left of a user wearing the backpack 10.

Figure 1:
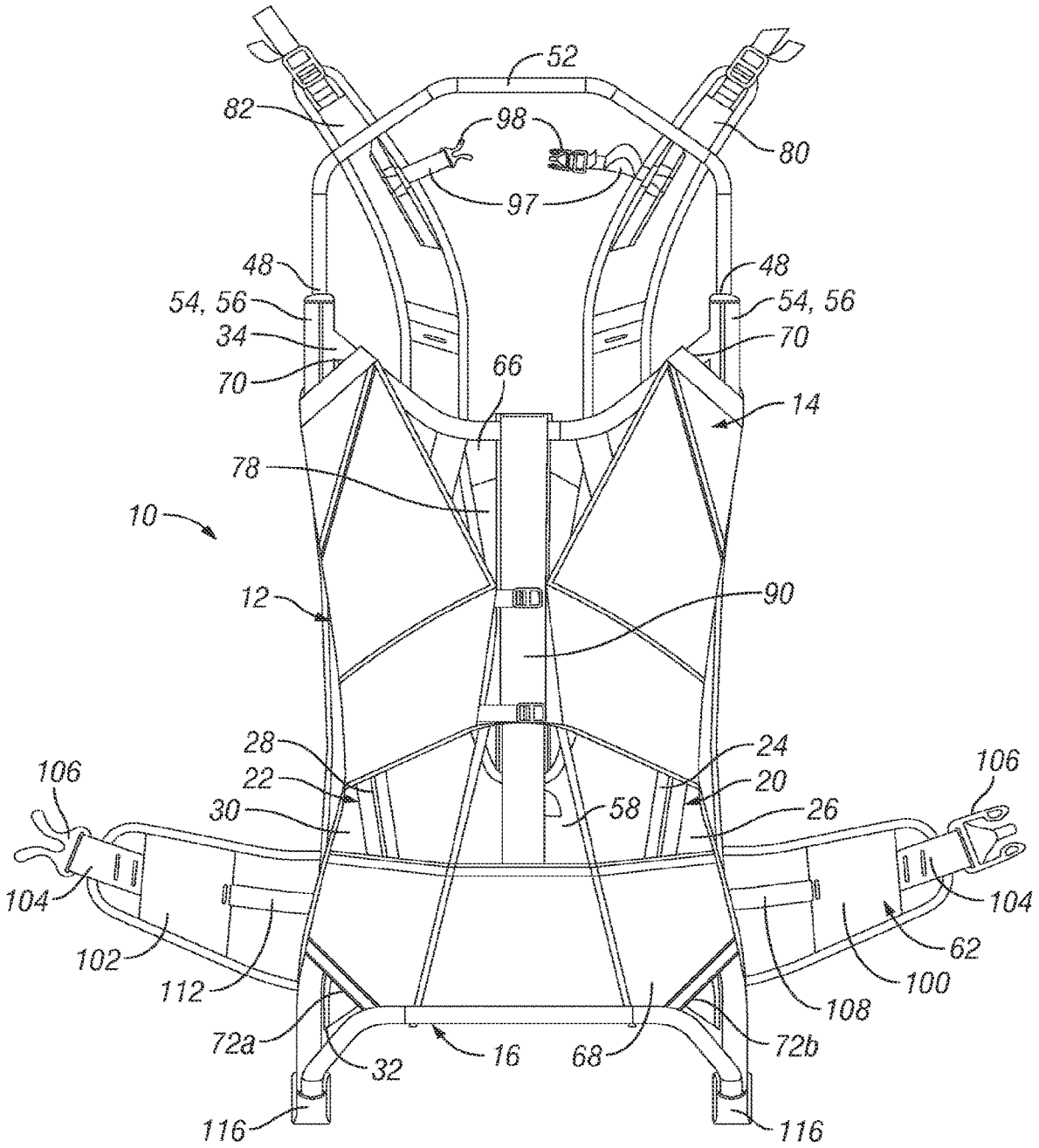
FIG. 1 is a back or rear view of an example backpack having a frame with two X rail sets.
Figure 2:
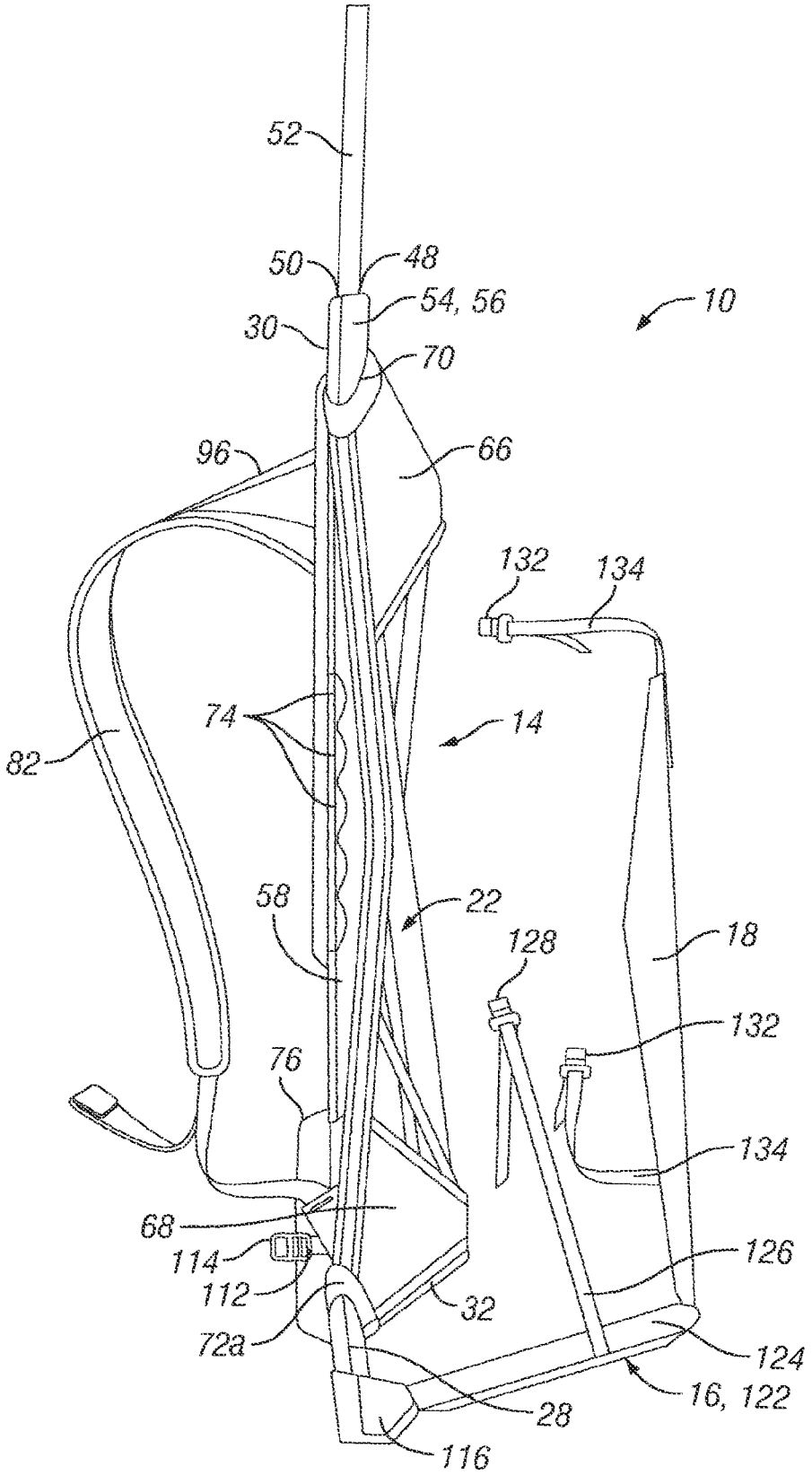
FIG. 2 is a left side view of the backpack of FIG. 1.
Figure 3:
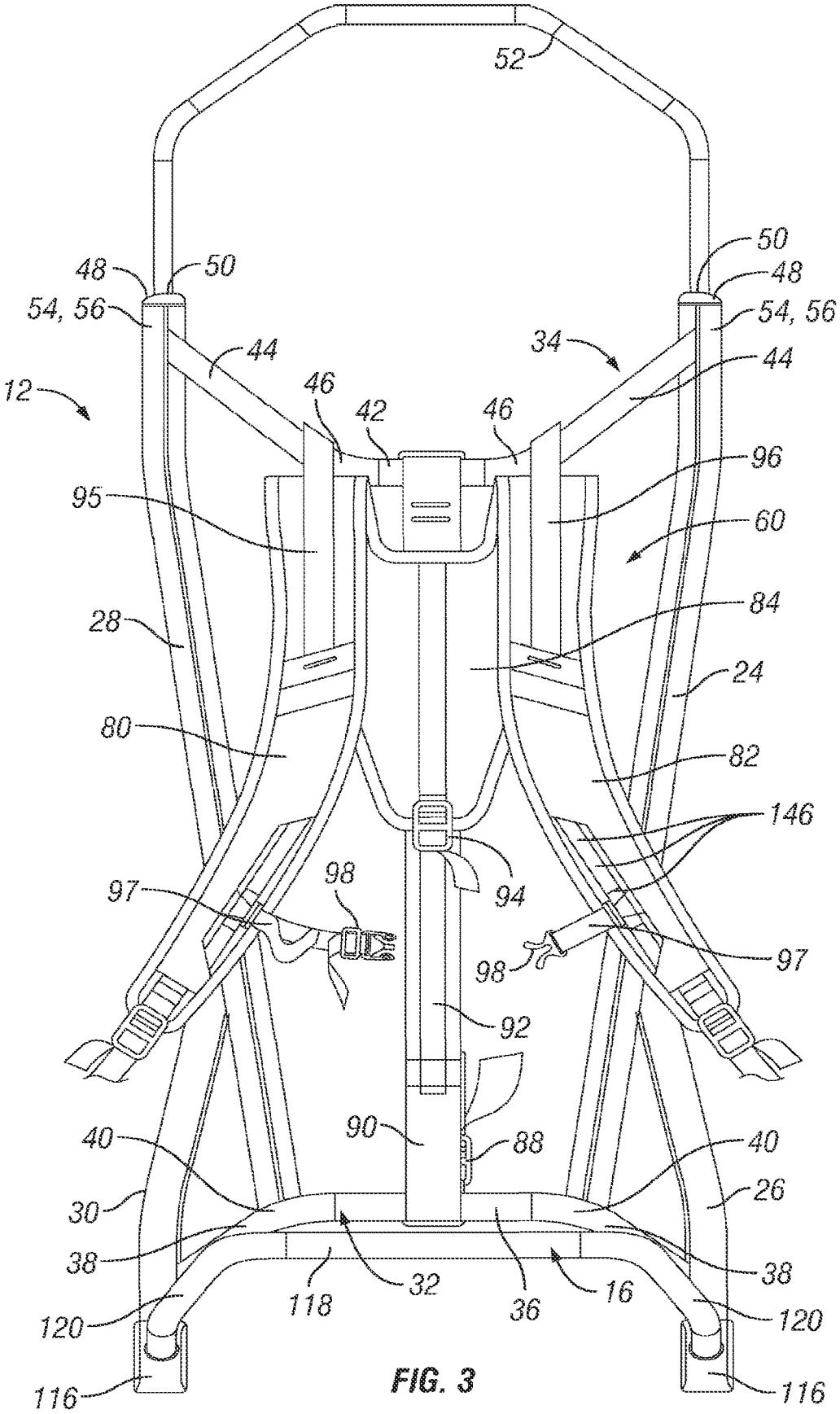
FIG. 3 is a front view of the frame of shoulder harness assembly of the backpack of FIG. 1.

An example embodiment of backpack 10 is shown in FIGS. 1-3. In the example depicted in FIG. 1, backpack 10 includes an external frame backpack, though it will be appreciated by one of ordinary skill in the art the present frame 12 may instead be incorporated into an internal frame backpack.

The backpack 10 may have a frame 12, a harness assembly 14, a freight shelf 16, and a compression pod 18 as shown in FIG. 2. The harness assembly 14 is shown in FIG. 3 attached to the frame 12, and by itself in an uninstalled state in FIG. 4. The frame 12 is shown in isolation in FIGS. 5-7. The frame 12 may be made of a lightweight but strong material, or combination of materials, such as aluminum, titanium, fiberglass, plastic, or any other suitable material. The frame 12, as shown in FIG. 5, has a right X rail set 20 and a left X rail set 22 that are generally parallel to each other and in a vertical orientation when the backpack 10 is worn on the back of a user. The right X rail set 20 has a first right rail 24 and a second right rail 26. The left X rail set 22 similarly has a first left rail 28 and a second left rail 30. The first right rail 25 and the first left rail 28 may be mirror images of one another and horizontally spaced apart when backpack 10 is viewed from the front or back, and similarly the second right rail 26 and the second left rail 30 may be mirror images of one another and horizontally spaced when backpack 10 is viewed from the front, as shown in FIG. 5, or back. The frame 12 has a lower cross member 32 and an upper cross member 34 extending generally horizontally in the horizontal direction. One or more of the lower cross member 32 and the upper cross member 34 may be curved in one or more planes so that both cross members may also extend somewhat in the vertical direction and/or the lateral direction between the right X rail set 20 and the left X rail set 22, as shown in FIGS. 5-7. In the embodiment shown in FIG. 1, the lower cross member 32 extends just above the lower distal ends of the X rail sets 20 and 22. The upper cross member 34 extends just below the upper distal ends of the X rail sets 20 and 22. The lower cross member 32 and the upper cross member 34 may each be welded, connected with fasteners, and/or attached in any other suitable manner to the right X rail set 20 and the left X rail set 22.

Referring to FIGS. 5-7, the right X rail set 20 (including rails 24 and 26) and the left X rail set 22 (including rails 28 and 30) form a primary support structure within frame 12. The rails making up each of rail sets 20 and 22 cross one another, not only in the laterally within frame 12 (see, for example, FIG. 5), but also in the front-to-back direction (see, for example, FIG. 6). Consequently, each rail set 20 and 22 provides support and strength to frame 12 in lateral and front-to-back directions.

Referring now to FIGS. 5-7, the lower cross member 32 may have a middle portion 36 with two lower leg portions 38 each extending from the middle portion 36 at a bend 40. The ends of the lower cross member 32 curve forward toward the back of the user, such that the two lower leg portions 38 extend in a forward direction from the middle portion 36 towards the back of the user and outwards towards the sides of the backpack 10. The upper cross member 34 may similarly have a middle portion 42 with two upper legs 44 each extending from the middle portion 42 at a bend 46. The ends of the upper cross member 34 curve toward the back of the user and upward in a vertical direction and outward in a horizontal direction, such that the two upper legs 44 may extend in a forward direction, outward in a horizontal direction, and upward in a vertical direction from the middle portion 42. The middle portions 36 and 42 and the legs 38 and 44 may be straight, may be slightly curved along their respective lengths, or may form one continuous curved member and the middle portions 36 and 42 and the legs 38 and 44 may connect to one another, for example, with a sharp bend or with rounded corners. The lower cross member 32 and upper cross member 34 may each have a generally circular cross section, or alternatively may have cross sections having any other suitable shape or combination of shapes, such as square, oval, or trapezoidal. The lower cross member 32 and the upper cross member 34 may be a solid bar to provide additional strength or a hollow tube to save weight, or combinations thereof.

Figure 9:
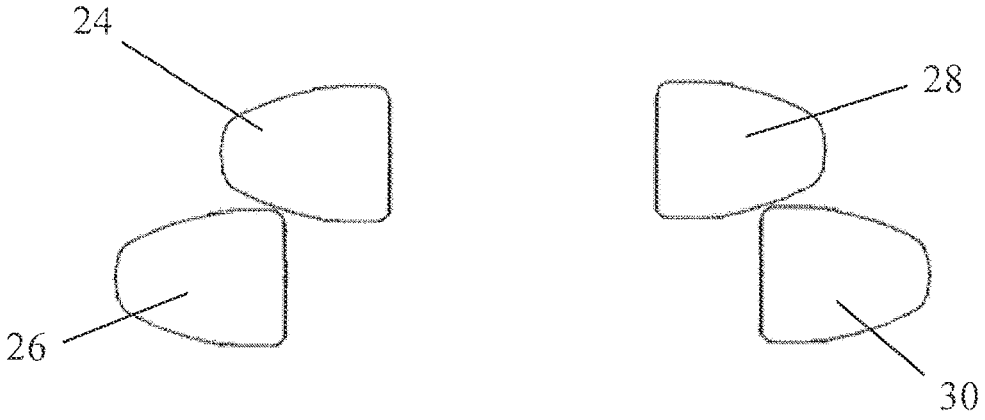
FIG. 9 is a cross sectional view of rails of FIG. 5 taken along line 9-9.

The right X rail set 20, as mentioned above and shown in FIG. 5, includes the first right rail 24 and the second right rail 26. The first right rail 24 and the second right rail 26 cross in front of one another to form an X-shape when viewed from the front (FIG. 5), side (FIG. 6), and/or top (FIG. 7) of the backpack 10. The first right rail 24 and the second right rail 26 may cross at some position between the upper and lower distal ends of the right X rail set 20, such as between one third of the vertical length above the lower distal end of the right X rail set 20 to half way between the lower and upper distal ends of the right X rail set 20. It will be appreciated that the first right rail 24 and the second right rail 26 may also cross above or below these points, and may cross close to where a user's elbows will be located when the backpack 10 is worn by a user. The first right rail 24 and the second right rail 26 may abut against one another at the point at which they cross, as shown in FIG. 9, but, in some embodiments, are not welded or fastened together at the abutment to allow the frame to flex and bend. If more rigidity is desired in the frame 12, then the first right rail 24 and the second right rail 26 may be permanently attached where the rails abut, such as through a weld or other attachment mechanism. Similarly, the first left rail 28 and second left rail 30 may be attached, such as through a weld, where the rails cross to provide a rigid frame 12. Alternatively, the rails may be spaced such that the first right rail 24 and the second right rail 26 are normally not in contact, but can flex to come into contact with one another. It will be appreciated that since the left X rail set 22 may be a mirror image of the first X rail set 20, the second X rail set 20 may similarly cross the first left rail 28 and the second left rail 30.

In this configuration, the right and left X rail sets 20 and 22 form cross-bracing members that support the frame 12 of the backpack 10 in vertical, horizontal, and lateral directions. As described below and illustrated in FIGS. 5-7, the rails 24, 26, 28, and 30 making up each of the first and second X rail sets 20 and 22 are installed into the frame 12 so that they not only connect the top of the frame 12 to the bottom of the frame 12, but so that the rails are also oriented in different directions. Moving from top to bottom of the frame 12, some of the rails, such as the second right rail 26 and the second left rail 30, are oriented so that they start at the back of the frame towards the middle and, moving downwards, move towards the outside and front of frame 12. Conversely, also moving from top to bottom of the frame 12, some of the rails, such as the first right rail 24, and the first left rail 2, are oriented so that they start at the front of the frame towards the outside and, moving downwards, move towards the middle and back of the frame 12. In this arrangement, the rails making up each rail set cross one another as they move through the frame 12 enabling each rail set to provide support to the frame 12 in several directions. This is in contrast to a conventional backpack frame in which the support members are generally all approximately parallel and co-planar, support is only provide in a single direction.

Figure 11:
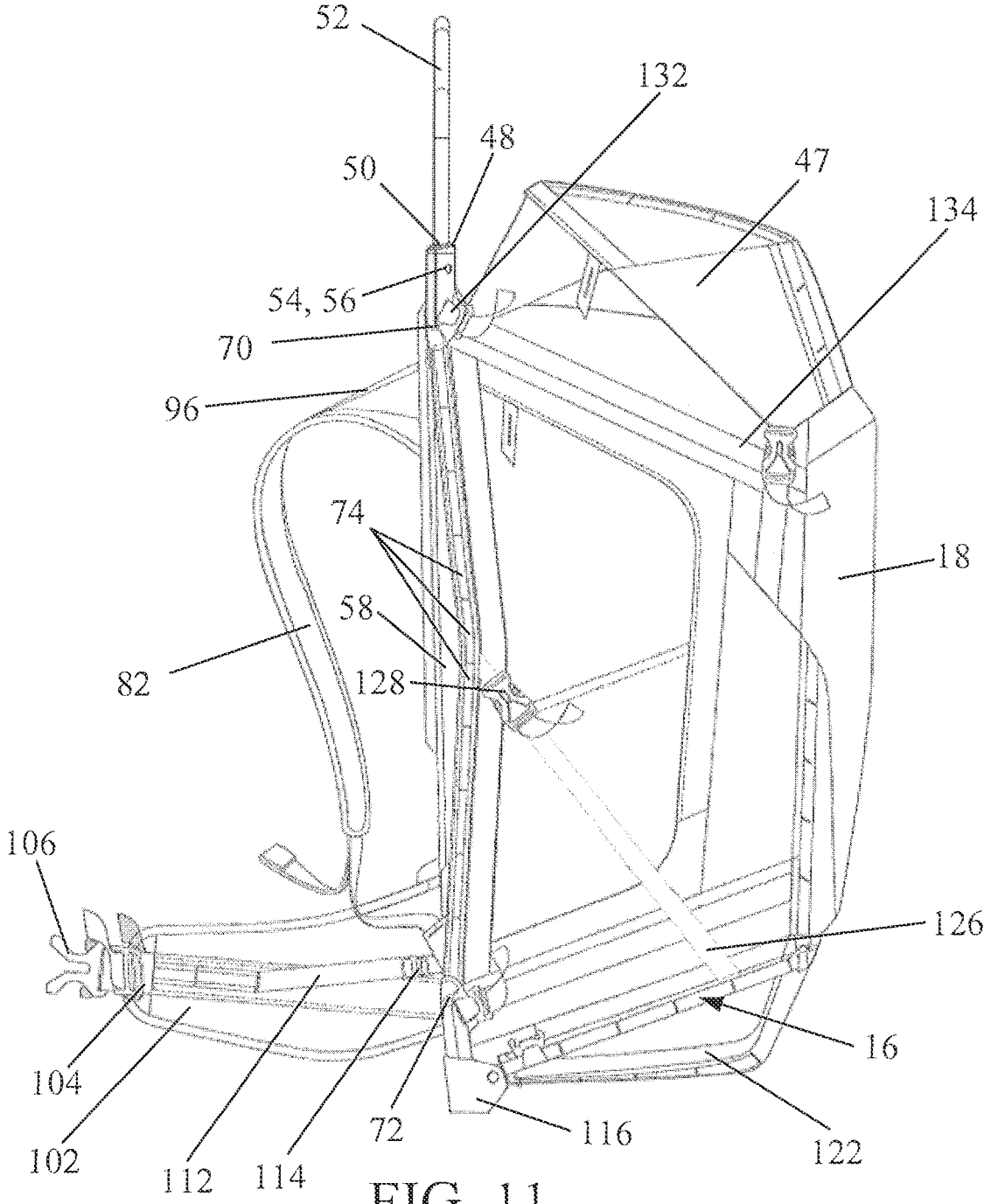
FIG. 11 is a side view of a backpack in accordance with the present disclosure.

As described below, the rails 24, 26, 28, and 30 making up the rail sets 20 and 22 are positioned within the frame 12 so as to make the backpack 10 more comfortable to wear by a user by presenting a narrower frame 12 towards the middle of the frame that does not impede the movement of a wearer's elbows. Further, as shown in FIG. 11, the wider sections towards the top and bottom of the frame 12 allow the user to attach a cargo 47 at a variety of connection points to the frame 12 to help distribute the weight of the cargo 47 and account for awkward sized cargos 47. Additionally, the curvatures of the lower cross member 32 and upper cross member 34 provide their respective middle sections 36 and 42 rearward of the user to provide ample space between the back of the user and the lower cross member 32 and upper cross member 34.

In forming frame 12, the right X rail set 20, the left X rail set 22, the lower cross member 32, and the upper cross member 34 may connect to form the frame 12 in a variety of ways. For example, the first right rail 24 and first left rail 28, toward their respective upper distal end, starts off toward the outside of the frame 12 on opposite sides of the frame 12 in a horizontal direction (shown in FIG. 5), and forward (closer to the back of the user) in a lateral direction (shown in FIG. 6). The first right rail 24 and first left rail 28 extend vertically downward and the sides of the first right rail 24 and the first left rail 28 attach to the opposite distal ends of the upper cross member 34. Below the upper cross member 34, the first right rail 24 and the first left rail 28 extend diagonally at an angle inward towards one another in a horizontal direction, in an aft lateral direction away from the user, and vertically downward. The lower distal ends of the first right rail 24 and the first left rail 28 attach to the top side of the lower cross member 32, such as at the middle portion 36 adjacent to the bends 40. The lower cross member 32 may be substantially parallel to the ground such that the middle portion 36 and the legs 38 are located entirely in the same horizontal and lateral plane parallel to the ground.

The upper distal ends of the second right rail 26 and the second left rail 30 attach to the bottom side of the upper cross member 34, such as on the legs 44. The second right rail 26 and the second left rail 30 extend diagonally at an angle outwards towards the outside of the pack in a horizontal direction, forwards towards the back of the user in a lateral direction, and downward in a vertical direction. The second right rail 26 and the second left rail 30 bend to a substantially vertical direction, with no horizontal movement or lateral movement, at roughly the same vertical height as the middle portion 36 of the lower cross member 32. The distal ends of the legs 38 of lower cross member 32 attaches to the sides of the second right rail 26 and the second left rail 30 at this vertical portion of the second right rail 26 and the second left rail 30. The second right rail 26 and the second left rail 30 continue to extend in the vertical direction downward from the legs 38 of the lower cross member 32. The substantially vertical ends of the first right rail 24 and second right rail 26 may be concentric with one another when viewed from above or below. Similarly, the ends of the first left rail 28 and second left rail 30 may be concentric with one another when viewed from above or below. It will be appreciated that the first right rail 24, the second right rail 26, the first left rail 28, and the second left rail 30 may alternatively be straight along their entire lengths, curved along their entire lengths, or some combination of straight and curved rails.

Plastic inserts 48, as shown in FIGS. 1 and 2, may be inserted into the upper distal ends of the second right rail 26 and the second left rail 30 to at least partially cover the distal ends of the second right rail 26 and the second left rail 30 to at least partially prevent debris from entering the second right rail 26 and second left rail 30 if the rails are hollow. The inserts 48 may have a hole 50 passing entirely through the insert 48 in a vertical direction.

The frame 12 can further include an extensible tube 52 in an inverted U-shape configuration. Alternatively, the extensible tube 52 may be in the shape of half an octagon with parallel elongated left and right sides. The extensible tube 52 may be extended or contracted in a vertical direction relative to the upper cross member 34. The lower ends of the extensible tube 52 telescope into the second right rail 26 and the second left rail 30, such as through the hole 50 in the inserts 48. The extensible tube 52 may have a height adjustment mechanism, such as a spring push pin 54 to adjust the height by interlocking with a hole 56 located on the first right rail 24 and the first left rail 28. It will be appreciated that a plurality of holes 56 may be provided at different vertical heights along the first right rail 24 and the first left rail 28 to provide multiple height adjustment options, as shown in FIG. 6. Alternatively, the extensible tube 52 may be adjustable through a twist and lock telescoping adjustment mechanism or any other suitable adjustment means. A user may also remove the extensible tube 52 entirely from the frame 12 to reduce the overall weight of the backpack 10. Adjusting the height of the extensible tube 52 allows a user to account for a taller or shorter cargo 47 and allows the backpack 10 to be used for a variety of tasks. A gap is formed between the installed extensible tube 52 and the upper cross member 34, such as through the downward curvature of the upper cross member 34 and upward curvature of the extensible tube 52, to provide comfort to the user by not interfering with the forward and backward movement of the head of the user.

The harness assembly 14, as shown in FIGS. 1-2, has a back panel 58, a shoulder strap assembly 60, a hip belt 62, a back support 64, an upper sleeve 66, and a lower sleeve 68. The upper sleeve 66 is attached towards the top of the back panel 58, such as along an upper edge of the back panel 58 and along the side edges towards the upper edge of the back panel 58. At least one opening 70 is formed between the upper sleeve 66 and the back panel 58 for allowing the first X rail set 20 and/or the second X rail set 22 to extend at least partially through the opening 70. For example, the first right rail 24 and the first left rail 28 may each pass partially through the opening 70. Alternatively as shown in FIG. 1, at least two openings may be provided such that the first right rail 24 passes through one opening 70 and the first left rail 28 passes through a second opening 70. The lower sleeve 68 attaches towards the bottom of the back panel 58, such that a portion of the lower side edges and bottom edges of the back panel 58 and the lower sleeve 68 are attached creating at least one opening, such as 72*a* and 72*b*, to allow the first X rail set 20 and the second X rail set 22 to extend at least partially through the openings 72*a* and/or 72*b*, as shown in FIG. 1.

Figure 10:
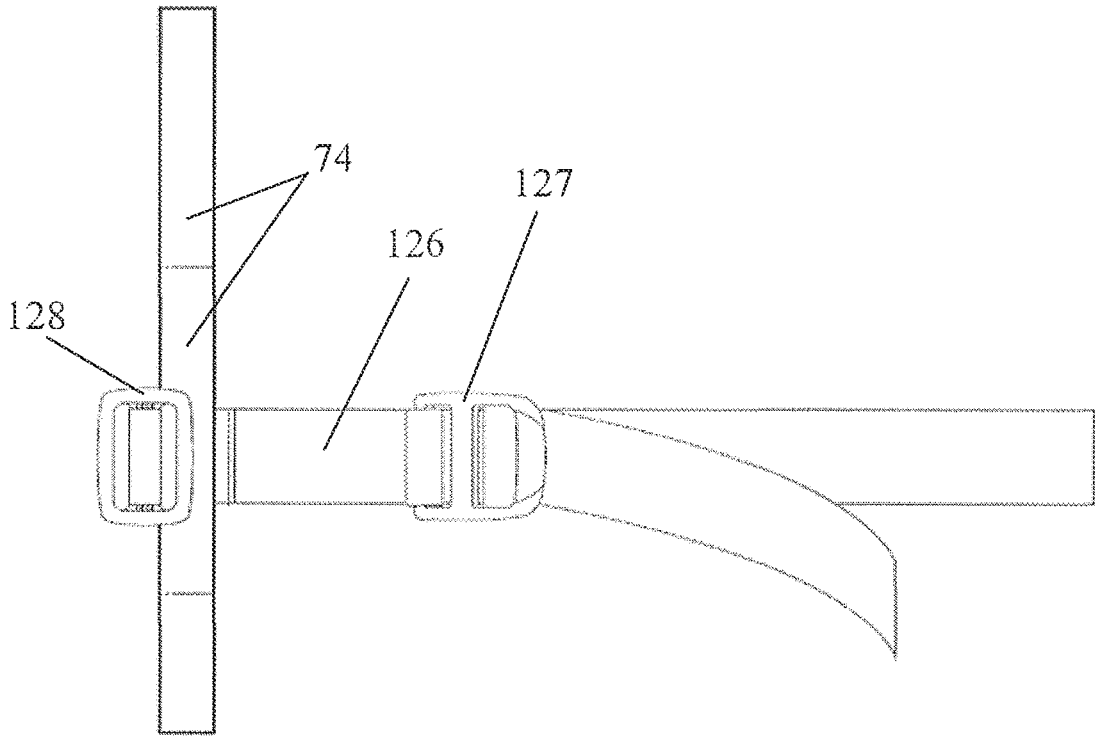
FIG. 10 is a detailed view of the loops illustrated in FIG. 2.

A plurality of loops 74, as shown in FIG. 2, may be attached in two vertical stacks, with one stack along the left side edge and the other stack along the right side edge of the back panel 58. The loops 74 may be attached to the rearward side of the back panel 58 and facing away from the user. Referring to FIG. 10, the loops 74 should be large enough to accept a buckle 128, as described below, but should be sufficiently small to prevent the buckle 128 from easily becoming detached from the loop 74 when the buckle 128 is attached.

The back panel 58 may also have a padded section 76 located on the front face of the back panel 58 for abutting against a user's back, just below the shoulders and on either side of the user's spine. A lower back padded section 76 may also be located on the front face of the back panel 58 for abutting against the lower back of a user when the backpack 10 is worn. Alternatively, the lower back padded section 76 may be located on the hip belt assembly 62. A shoulder strap opening 78 may extend through the back panel 58 for allowing the shoulder strap assembly 60 to pass between the front and back of the back panel 58.

Figure 4:
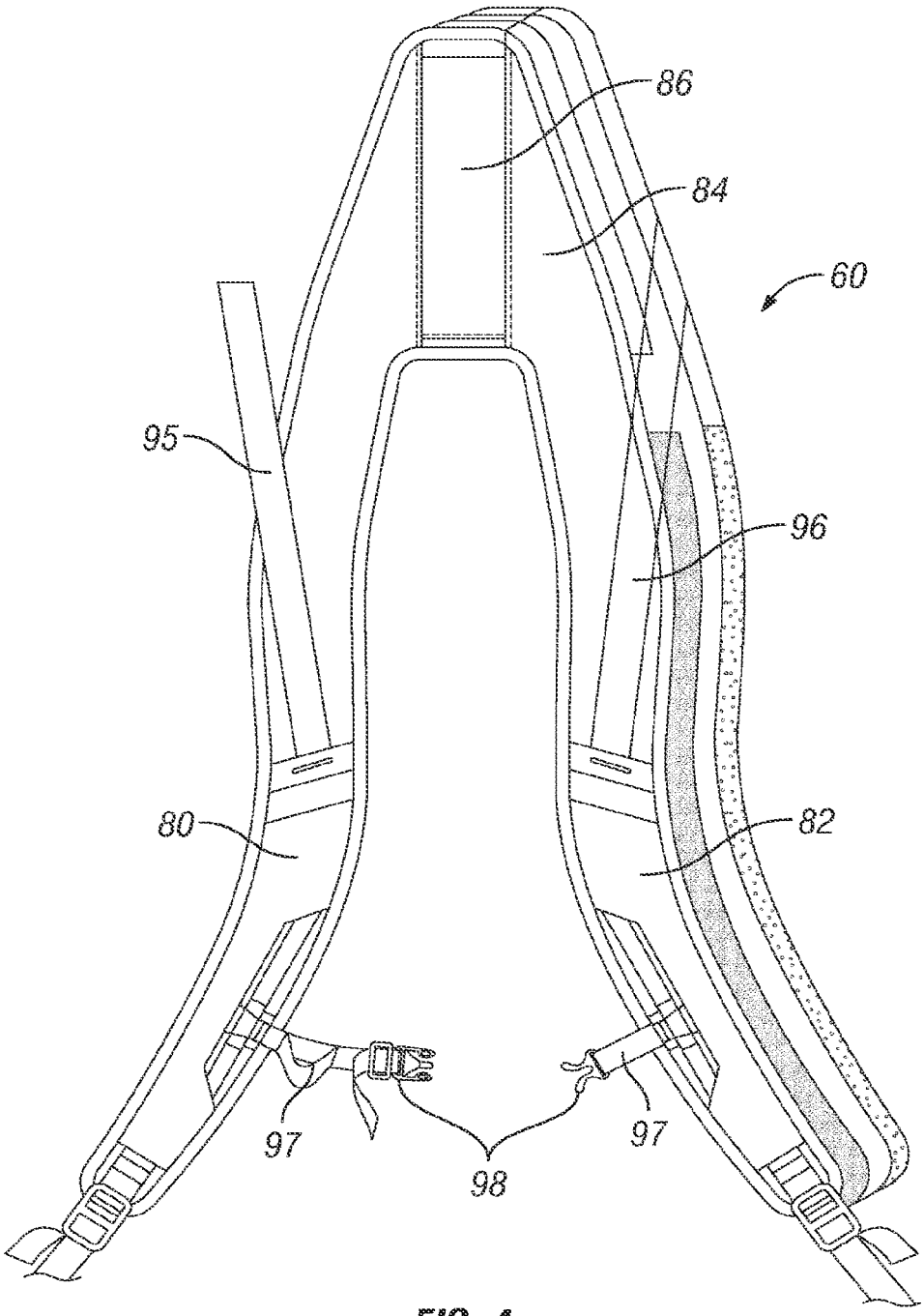
FIG. 4 is a front view of the shoulder harness assembly of FIG. 3

The shoulder strap assembly 60, as shown in greater detail in FIGS. 3 and 4, may include a right shoulder strap 80 and a left shoulder strap 82. The right shoulder strap 80 may partially support the backpack 10 by fitting over the user's right shoulder. Similarly the left shoulder strap 82 may partially support the backpack 10 by fitting over the user's left shoulder. Referring to FIG. 4, the right shoulder strap 80 and left shoulder strap 82 may connect at a middle portion 84 to form a V shape. The middle portion 84 may have a sleeve 86 open on its top and bottom, but attached on its sides for accepting a center retaining strap 88. Referring again to FIG. 3, the center retaining strap 88 may pass between the middle portion 84 and the sleeve 86, and may consist of two strap lengths, with one strap length passing vertically up and over the upper cross member 34 to attach to the upper sleeve 66 on one end and coupled to a retaining buckle 90 on the other end. One end of the second length of the center retaining strap 88 may pass under and around the lower cross member 32 and attach to the lower sleeve 68. The other end of the second length of the center retaining strap 88 may couple to the retaining buckle 90. The center retaining strap 88 may attach to the back panel 58, the upper sleeve 66, and/or the lower sleeve 68. A clamping force may be applied to the frame 12 to retain the harness assembly 14 to the frame 12 by reducing the length of strap 92 between the retaining buckle 94 and the upper sleeve 66 and/or the length of strap between the retaining buckle 94 and the lower sleeve 68.

The center adjustment strap 88, a right shoulder tether 95, and a left shoulder tether 96, as shown in FIG. 3, may be used to adjust the vertical height of the shoulder strap assembly 60 to accommodate for the height of the user. The right shoulder tether 95 and the left shoulder tether 96 may prevent the shoulder strap assembly 60 from sliding vertically downward, while the center adjustment strap 88 may prevent the shoulder strap assembly 60 from sliding vertically upward. The center adjustment strap 88 may consist of two strap lengths coupled through an adjustment buckle 94. One strap length may be attached on one end to the middle portion 84 and coupled to the adjustment buckle 94 on the other end. The second strap length of the center adjustment strap 88 may be attached to the center retaining strap 88 on one end, and to the adjustment buckle 94 on the other end. Alternatively, the second strap length of the center adjustment strap 88 may be attached to a different anchor point, such as the back panel 58, the lower cross member 32, the lower sleeve 68, or any other suitable location. The right shoulder tether 95 may attach on one end to the right shoulder strap 80 and may be anchored on the second end, for example, to the upper cross member 34, the back panel 58, or the upper sleeve 66. The right shoulder tether 95 may have a length adjustment mechanism, such as a buckle for adjusting the length of the tether 95. Similarly, the left shoulder tether 96 may attach on one end to the left shoulder strap 82 and may be anchored on the second end, for example, to the upper cross member 34, the back panel 58, or the upper sleeve 66. The left shoulder tether 96 may have a length adjustment mechanism, such as a buckle for adjusting the length of the length of the tether 96. The right shoulder strap tether 95 and the left shoulder strap tether 96 may be lengthened to raise the vertical height of the right shoulder strap 80 and the left shoulder strap 82 relative to the frame 12, or shortened to lower the vertical height relative to the frame 12. It will be appreciated that the right shoulder strap tether 95 and the left shoulder strap tether 96 may be adjusted together or separately.

An adjustable chest strap 97 may extend between the right shoulder strap 80 and the left shoulder strap 82. The chest strap 97 consists of two strap portions releasably coupled together through a chest strap buckle 98, such that one strap portion is adjustably attached to the right shoulder strap 80 and the other strap portion is adjustably attached to the left shoulder strap 82. The chest strap 97 may also be adjustable in length through the chest strap buckle 98. The chest strap 97 may also be adjusted in a vertical direction, such as through a sliding mechanism, a pair of hooks 144 with a vertical set of loops 146 attached to both the right shoulder strap 80 and the left shoulder strap 82, or in any other suitable manner. The loops 146 on the right shoulder strap 80 should have a corresponding loop 146 on the left shoulder strap 82 at a similar vertical location. To adjust the vertical location of the chest strap 97, the right hook 144 is inserted into the desired loop 146 on the right shoulder strap 80. Similarly the left hook is inserted into the desired loop 146 on the left shoulder strap 82.

Referring to FIG. 1, the hip belt assembly 62 may have a right hip belt 100 and a left hip belt 102. A first distal end of the right hip belt 100 may be attached to the back panel 58 adjacent to the lower back padded section 76. Similarly, a first distal end of the left hip belt 102 may be attached to the back panel 58 adjacent to the lower back padded section 76. Alternatively, the right hip belt 100 and the left hip belt 102 may form one piece with the lower back padded section 76 attached to the hip belt between the right hip belt 100 portion and the left hip belt 102 portion. The inside portion of the right hip belt 100 and the left hip belt 102, facing the user, may be padded. A main belt adjustment strap 104 may include two strap lengths coupled to a releasable main belt buckle 106. The right portion of the main belt adjustment strap 104 may be attached on one end to the right hip belt 100 and on the other end to the main belt buckle 106. The left portion of the main belt adjustment strap 104 may be attached on one end to the left hip belt 102 and on the other end to the main belt buckle 106. The main belt buckle 106 may be a side release buckle, or similar releasable buckle, such that a male portion of the main belt buckle 106 attaches to one of the right hip belt 100 and the left hip belt 102, and the female portion of the main belt buckle attaches to the other one of the right hip belt 100 and the left hip belt 102. The main belt buckle 106 and main belt adjustment strap 104 may be used to change the inner circumference of the hip belt assembly 62 to accommodate waist size of the user.

A right belt adjustment strap 108 and a right belt adjustment buckle 110 may tether the right belt 100 to the right side of the back portion 58, the lower sleeve 68, and/or the first right rail 24. The right belt adjustment strap 108 and the right belt adjustment buckle 110 may be used to adjust the weight distribution of the cargo 47 between the frame 12 and the right hip belt 100 or to center the frame 12 with respect to the user in a horizontal direction by increasing or decreasing, through the right belt adjustment buckle 110, the strap length between the anchor point and the right hip belt 100. Similarly, a left belt adjustment strap 112 and a left belt adjustment buckle 114 may tether the left hip belt 102 to the side of the back panel 58, the lower sleeve 68, and/or the first left rail 28. The left belt adjustment strap 112 and the left belt adjustment buckle 114 may be used to adjust the weight distribution of the cargo 47 between the frame 12 and the left hip belt 102 or to center the frame 12 with respect to the user in a horizontal direction by increasing or decreasing the strap length between the anchor point and the left hip belt 102 through the left belt adjustment buckle 112.

As shown in FIGS. 2, 5, and 6, hinges 116 may be attached to the bottom of the first X rail set 20 and the second X rail set 22, such as to the second right rail 26 and the second left rail 30. The hinges 116 may have a flat bottom, to support the backpack 10 when it is set on the ground. The hinges 116 may additionally have ridges or protrusions on the flat bottom to prevent the backpack 10 from sliding along the ground. The freight shelf 16, as shown in FIGS. 2 and 6, rotatably attaches to the bottom of the second right rail 26 and the second left rail 30, such as through the hinges 116. Referring to FIG. 7, the freight shelf 16 may be in a U-shape or C-shape configuration, with each distal end connecting to the hinges 116. The freight shelf 16 may be formed as a curved member with a circular cross section, or alternatively may have a middle portion 118 and two legs 120 extending from the ends of the middle portion 118. The middle portion 118 and legs 120 may be straight or curved. The hinges 116 allow the freight shelf 16 to rotate, such as through a pivot pin or rod, between a substantially horizontal position, and perpendicular to the right X rail set 20 and left X rail set 22, when the freight shelf 16 is being used to support the cargo 47 and a substantially vertical position, approximately parallel to the right X rail set 20 and left X rail set 22, when the freight shelf 16 is not in use. It will be appreciated that the freight shelf 16 may also be secured at a variety of angles between the horizontal position and the vertical position. Referring to FIGS. 2 and 10, a canvas bottom 122 can stretch between and attach to the freight shelf 16, such as through loops or a sleeve 124 passing along the periphery of the canvas bottom 122, and passing over the middle portion 118 and legs 120 of the freight shelf 16. Each strap 126, may be shortened or lengthened through a respective buckle 127. Two straps 126 may be attached permanently or semi-permanently to left and right outer sides of the canvas bottom 122 to support the freight shelf 16 when the freight shelf 16 is in the extended position, or to hold the freight shelf 16 against the frame 12 in the stored position. The straps 126 may, for example, be made of a woven webbing material and have the plastic or metal buckle 128 at the end, as shown in FIG. 10. The buckle 128 may be permanently attached to the strap 126. To secure the buckle to the loops 74, the buckle is passed between the loops 74 and the back panel 58. The buckle 128 is then secured by placing the buckle outward of the loop 74, such that the loop 74 is between the buckle 128 and the strap 126. Alternatively, the buckle 128 may be in the form of a hook 128, as shown in FIG. 2, or as a detachable snap buckle 128 as shown in FIG. 11. The back panel 58 may have a plurality of loops 74 attached along its sides and stacked in a vertical direction for interfacing with the hook 128. Referring to FIG. 10, The hook 128 may fit into one of the loops 74 attached along the sides of the back panel 58 depending on the desired angle of the freight shelf 16 relative to the frame 12. For example, a vertically higher loop 74 would result in the shelf being supported at an smaller angle between the freight shelf 16 and the frame 12, while a vertically lower loop 74 would result in the shelf being supported at a greater angle between the freight shelf 16 and the frame 12. The length of the straps 126 may be adjusted through a slit in the hook 128 to account for the loop 74 being used and the angle of the freight shelf 16 relative to the frame 12.

A compression pod 18, as shown in FIG. 2, may also be attached to the canvas bottom 122 near the middle portion 118. The compression pod 18 may be made out of canvas, and be a rectangular, trapezoidal, or any other suitable shape. A plurality of compression pod straps 134, such as two, may be attached to the compression pod 18, such as towards the top edge of the compression pod 18, and each compression pod strap 134 may have a hook 132. Additional straps may be provided along the sides of the compression pod 18 to provide additional support to the cargo 47. The length of the compression pod straps 134 may be adjusted, such as through a slit in the hook 132 to provide adequate compression and support between the compression pod 18, the freight shelf 16, and the frame 12. The compression pod 18 may also be made of a bright and/or colorful material for easy identification or spotting, such as during hunting season.

The first right rail 24, second right rail 26, first left rail 28, and second left rail 30 may be hollow or solid with a variety of geometries. For example, in one embodiment the rails 24, 26, 28, and 30 may have cross sections that are triangular in shape. Alternatively, the rails 24, 26, 28, and 30 may have cross sections that are oval, circular, or any other suitable shape.

Figure 8:
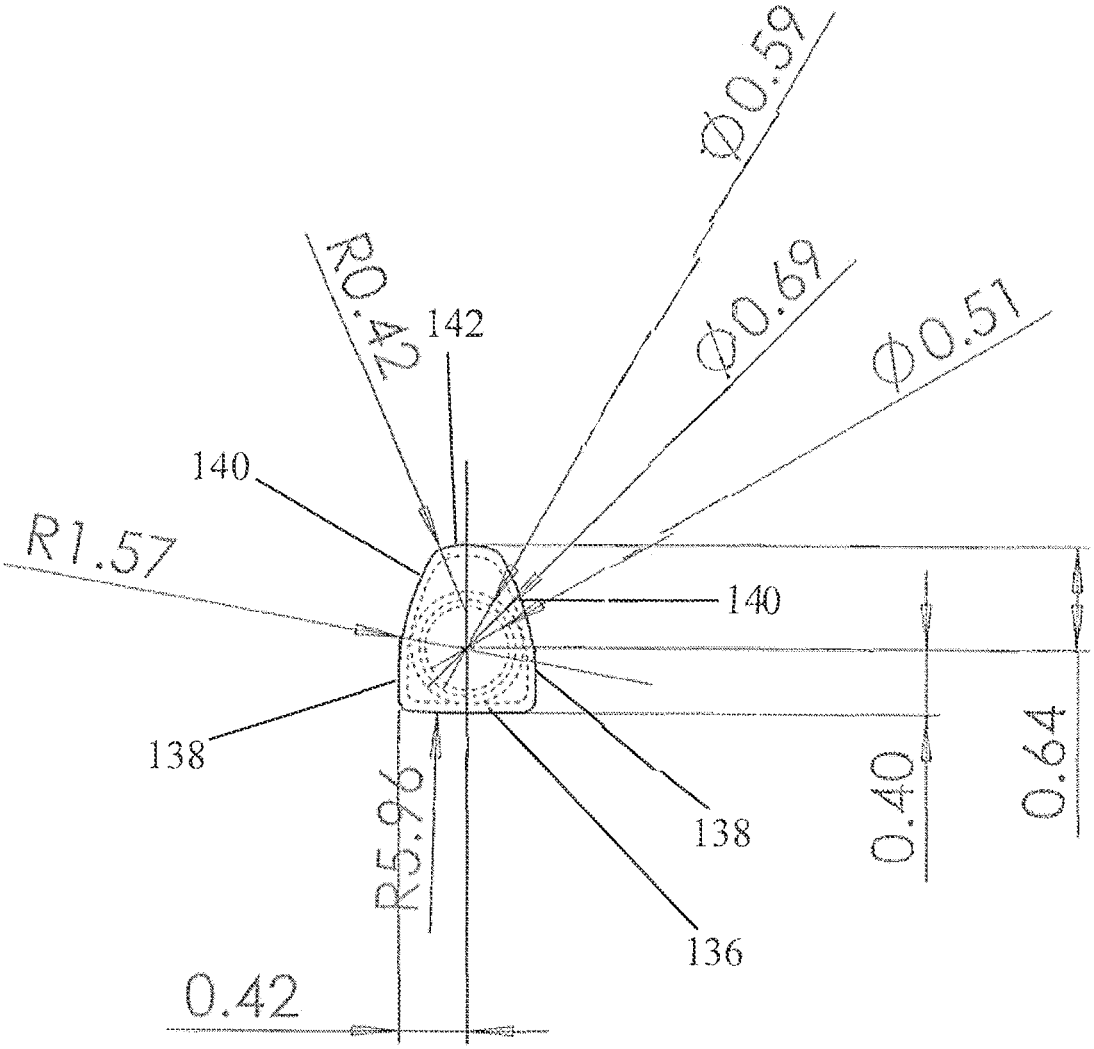
FIG. 8 is a cross sectional view of a portion of a rail of the present backpack frame taken along line 9-9 of FIG. 5.

In another embodiment the rails 24, 26, 28, and 30 have a generally trapezoidal cross section, as shown in FIGS. 8 and 9. The trapezoidal shape, as shown in FIG. 8 may generally have a height of approximately 0.64 inches and a base of approximately 0.84 inches. The trapezoidal shape may have a generally flat back 136, which may be approximately 0.84 inches long. Alternatively, the back 136 may have a slight curvature, such as with a radius of 5.96 inches. Two sides 138 are attached to the ends of the back 136 at an approximately 90 degree angle, such that they are approximately parallel to one another, and may or may have a rounded corner between the back 136 and the sides 138 to reduce stress in the rails 24, 26, 28, and 30 and to reduce the wear of any components coming into contact with the corner between the back 136 and the sides 138, such as the harness assembly 14. The sides 138 may have a length of approximate 0.4 inches and may extend generally in the same direction as one another. Two tapers 140 may be attached to the ends of the sides 138 opposite the back 136. The tapers 140 may follow a curved path inward towards each other and extending in a direction away from the back 136, and have a radius of curvature of approximately 1.57 inches. The opposite end of the tapers 140 may be connected to a tip 142. The radius of curvature for the corner between the tapers 140 and the tip 142 may be approximate 0.42 inches. It will be appreciates that all of the rails 24, 26, 28, and 30 may have the same cross section and dimensions, or may have different cross sections and/or dimensions.

Referring to FIG. 9 and the right X rail set 20 and the left X rail set 22. The tips 142 of the first right rail 24, the second right rail 26, the first left rail 28, and the second left rail 30 may point in an outward horizontal direction from the backpack 10. In other words, the first right rail 24 and the second right rail 26 may point towards the right, and the first left rail 28 and the second left rail 30 may point towards the left. As mentioned above, the first right rail 24 and the second right rail 26 may abut and the first left rail 28 and the second left rail 30 may abut, as shown in FIG. 9. For example, the first right rail 24, along one of the tapers 140, may abut the second right rail 26 along the corner or curved connection between the back 136 and one of the sides 138. The first left rail 28 and the second left rail 30 may abut in a similar manner. Alternatively the tips 142 may be oriented in any other suitable direction, such as all of the tips 142 pointing in a rearward or forwards, or the tips 142 may point inwards in a horizontal direction. The tips 142 of the first right rail 24 and the second right trail 26 may also point in different directions than one another, and similarly with the tips 142 of the first left rail 28 and the second left rail 30.

The harness assembly 14 may be installed on the frame 12 by removing the extensible tube 52 from the frame 12 by pressing in on the spring push pins 54 to manipulate them through the holes 56, and then sliding the extensible tube 52 vertically upward and away from the frame 12 until the extensible tube 52 exits the holes 50 in the insert 48. The harness assembly 14 may slide over the top of the frame 12 such that the back panel 58 passes along the front side of the frame and the upper sleeve 66 and lower sleeve 68 pass along the sides and back side of the frame 12. The harness assembly 14 is moved vertically downward until the upper sleeve 66 abuts against the upper cross member 34. The center retaining strap 88 may then be passed along the front of the frame 12 downward below the lower cross member 32, and then rearward and upward around the lower cross member 32. The center retaining strap 88 can then be threaded into the retaining buckle 90, and the center retaining strap 88 can be shortened through the retaining buckle 90 until the center retaining strap 88 and upper sleeve 66 sufficiently clamp against the lower cross member 32 and upper cross member 34 respectively to retain the harness assembly 14 against the frame 12.

A user may adjust the harness 14 in a variety of ways to properly fit the user. The user can adjust the harness 14 to fit her torso height by initially lengthening or shortening the length of the center adjustment strap 92 through the adjustment buckle 94. The user can place her arms through the right shoulder strap 80 and the left shoulder strap 82 and may finish the height adjustment by adjusting the length of the right shoulder strap tether 95 and the left shoulder strap tether 96. The user may couple the right hip belt 100 and left hip belt 102 to encompass her waist by engaging the main belt buckle 106 and then lengthening or shortening the main belt adjustment strap 104 to account for her waist size. Similarly, the user may adjust the right belt adjustment strap 108 and left belt adjustment strap 112 by lengthening or shortening the right belt adjustment strap 108 and left belt adjustment strap 112 through the right belt adjustment buckle 110 and the left belt adjustment buckle 114 respectively to account for the distribution and weight of the cargo 47.

The freight shelf 16 may be moved from the stored position to the extended position. To move the freight shelf 16 to the stored position, the freight shelf 16 is rotated about the hinges 116, such that the freight shelf 16 is rotated toward the frame 12. Once the freight shelf 16 abuts against, or is sufficiently close to, the frame 12, the hooks 128 of the straps 126 may be inserted into the loops 74 of the harness assembly 14. The length of the straps 126 can then be adjusted through the hooks 128 and shortened until the straps 126 retain the freight shelf 16 securely against the frame 12. To move the freight shelf 16 to the extended position, the straps 126 may be loosened by increasing the length of the straps 126 through the hooks 128. The hooks 128 are removed from the loops 74, allowing the freight shelf 16 to rotate relative to the frame 12. The freight shelf 16 is then rotated downward until it is in the desired position. The straps 126 are then lengthened and the hooks 128 are inserted into the desired loops 74. Choosing a vertically lower loop 74 will result in a greater angle between the frame 12 and the freight shelf 16. The straps 126 are then shortened through the hooks 128 until the freight shelf 16 is sufficiently supported at the desired position relative to the frame 12.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the any use of terms "comprises" and/or "comprising" in this specification specifies the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A backpack frame having a top end, a bottom end, a forward face for facing the wearer and a rearward face for mounting a backpack, comprising:

first right and left rails on the right and left sides of the backpack frame, respectively, the upper ends of the first right and left rails adjacent the top of the backpack frame being spaced further apart than the lower ends of the first right and left rails adjacent the bottom of the backpack frame;

second right and left rails on the right and left sides of the backpack frame, respectively, the upper ends of the second right and left rails adjacent the top of the backpack frame being spaced more closely than the lower ends of the second right and left rails adjacent the bottom of the backpack frame;

a rigid upper cross member connecting the first right and left rails and the second right and left rails adjacent their respective upper ends;

a rigid lower cross member connecting the first right and left rails and the second right and left rails adjacent their respective lower ends;

the second right and left rails extending between the first right and left rails, with the upper ends of the second right and left rails positioned rearward of the upper ends of the first right and left rails, and the lower ends of the second right and left rails positioned forward of the upper ends of the first right and left rails, the width of the backpack frame being narrower intermediate the upper and lower cross member than at either the upper and lower cross members, wherein the first right and left rails and the second right and left rails are rigid and do not cross a vertical centerline of the backpack frame.

2. The backpack frame according to claim 1 wherein the width of the frame is narrowest at a point between one third and one half of the distance from the lower ends of the first and second rails and the upper ends of the first and second rails.

3. The backpack frame according to claim 1 wherein the width of the frame adjacent the top of the frame is defined by the spacing of the first right and left rails, and wherein the width of the frame adjacent the bottom of the frame is defined by the spacing of the second right and left rails.

4. The backpack frame according to claim 1 wherein the rigid upper cross member and the rigid lower cross member each extend generally horizontally.

5. The backpack frame according to claim 1 wherein the rigid upper cross member extends generally rearwardly and downwardly from respective sides of the first left and right rails, wherein upper ends of the first left and right rails extend above the rigid upper cross member, and wherein upper ends of the second left and right rails terminate at and are joined to the rigid upper cross member.

6. The backpack frame according to claim 5 wherein the rigid lower cross member extends generally rearwardly and upwardly from respective sides of the second left and right rails, wherein lower ends of the second left and right rails extend below the rigid lower cross member, and wherein bottom ends of the first left and right rails terminate at and are joined to the rigid lower cross member.

7. The backpack frame of claim 6 further comprising an extensible member connected to the frame and configured to extend in a vertical direction away from the rigid upper cross member, wherein a first end of the extensible member is connected to the upper end of the first left rail and a second end of the extensible member is connected to the upper end of the first right rail.

8. The backpack frame according to claim 1 wherein the first left and right rails are oriented symmetrically about the vertical centerline of the frame, and the second left and right rails are oriented symmetrically about the vertical centerline of the frame.

9. The backpack frame according to claim 1 wherein the first left and right rails form the upper portion of the front of the frame facing the wearer's back, and the second left and right rails form the lower portion of the front of the frame facing the wearer's back.

10. The backpack frame of claim 1, wherein the first left and right rails and the second left and right rails are hollow.

11. The backpack frame of claim 10 wherein the rigid upper cross member and the rigid lower cross member are hollow.

12. The frame of claim 1, including a freight shelf hingedly attached to the frame.

* * * * *